US005357889A

United States Patent [19]

Wood

[11] Patent Number: 5,357,889

[45] Date of Patent: Oct. 25, 1994

[54] WATERCRAFT AUTOPILOT ACTUATOR

[76] Inventor: Robert A. R. Wood, 3396 Marine Dr., West Vancouver, British Columbia, Canada, V7V 1M9

[21] Appl. No.: 143,260

[22] Filed: Oct. 27, 1993

[51] Int. Cl.[5] ..... B63H 25/04

[52] U.S. Cl. ..... 114/144 E; 114/144 R

[58] Field of Search ..... 114/144 R, 144 E, 144 A; 74/480 B, 388 PS; 318/588

[56] References Cited

U.S. PATENT DOCUMENTS

| | | | |
|---|---|---|---|
| 2,796,576 | 6/1957 | Braddon et al. . | |
| 3,138,133 | 6/1964 | Hatch . | |
| 3,603,167 | 9/1971 | Arce | 114/144 R |
| 4,170,953 | 10/1979 | Pounder et al. | 318/588 X |
| 4,314,520 | 2/1982 | Kosic | 114/144 R |
| 4,449,420 | 5/1984 | Baba | 114/144 R X |
| 4,681,055 | 7/1987 | Cyr . | |

*Primary Examiner*—Sherman Basinger
*Attorney, Agent, or Firm*—Herbert W. Larson

[57] ABSTRACT

An actuator housing securely attached to a back wall of a rotary helm unit mounted below the dashboard of a watercraft provides a mechanism for automatic control of the watercraft's rudder. The actuator housing encloses a wheel shaft extension passing through an axial bore in a back wall of the rotary helm unit. A first end of the wheel shaft extension within the actuator housing has a drilled out core containing a spring. The spring exerts a force against a pusher shaft axially aligned with the wheel shaft extension. A transverse pin integral with the pusher shaft is located adjacent a gear affixed to the pusher shaft. When the spring is overcome by a contra force exerted on the pusher shaft, the transverse pin seats within two oppositely positioned grooves on the wheel shaft extension and causes the wheel shaft to turn in response to a system of gears activated by an electric motor mounted adjacent the actuator housing. Turning of the wheel shaft extension activates a gear system within the rotary helm unit that moves the watercraft's rudder cables.

15 Claims, 4 Drawing Sheets

WATERCRAFT AUTOPILOT ACTUATOR

BACKGROUND OF THE INVENTION

This invention relates to automatic pilot systems for outboard engine driven watercraft. More specifically, it refers to an actuator device for accepting signals from an autopilot unit and inputting mechanical force to a rotary helm unit with a telescopic output cable for outboard steerage purposes.

Autopilot systems for large vessels are well known and have been in commercial use for many years. Autopilot systems also have been adapted for use in smaller craft including those driven by outboard engines as set forth in U.S. Pat. No. 4,681,055. Since space is limited on outboard engine driven watercraft, a search has been made for autopilot systems requiring no autopilot drive components mounted between the dashboard area and the steering wheel and which can be connected to commonly used rotary helm units with telescopic cables. The U.S. Pat. No. 4,681,055 description attempts to create such a design by incorporating a steering wheel adapter driven by a first and second gear within a housing mounted between the steering wheel and dashboard panel. The normal rotary helm unit connected to the outboard steering mechanism is located separately below the dashboard panel. The combined autopilot and rotary helm units bolted individually, demand utilization both above and below the dashboard and result in stresses being introduced into the dashboard in reaction to torque produced by the drive gears. A more advanced design is needed requiring no above dashboard mounting space and restraining all steering wheel shaft torque to within a single housing.

SUMMARY OF THE INVENTION

I have invented an autopilot actuator incorporating a standard rotary helm unit and an automatic pilot drive system into a unitary housing below a watercraft's dashboard panel. When the automatic pilot is in use no additional torque is transferred to the dashboard mounting as all torque is contained within the single housing unit.

My autopilot actuator has a housing securely mounted to the rotary helm unit housing. The actuator housing is open at an end adjacent a back wall of the rotary helm unit and has a cover plate distal from the rotary helm unit back wall. The actuator housing encloses a steering shaft extension mounted through an axial bore in the back wall of the rotary helm unit. The steering shaft extension has a drilled out core containing a spring. A pair of oppositely positioned grooves at a first end of the steering shaft extension within the actuator housing receives a transverse pin integral with a pusher shaft in axial alignment with the steering shaft extension. The pusher shaft must overcome the force exerted by the spring in order to seat the transverse pin in the grooves. A plunger attached to and actuated by a clutch solenoid moves the pusher shaft to overcome the force exerted by the spring. A series of reducing gears activated by a motor turns a gear on the pusher shaft when the transverse pin is seated in the grooves. This turns the steering shaft extension and a second end of the steering shaft extension attached to a pinion gear within the rotary helm unit causes the rotary helm unit to activate and move telescopic steering cable controlling the watercraft's rudder.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
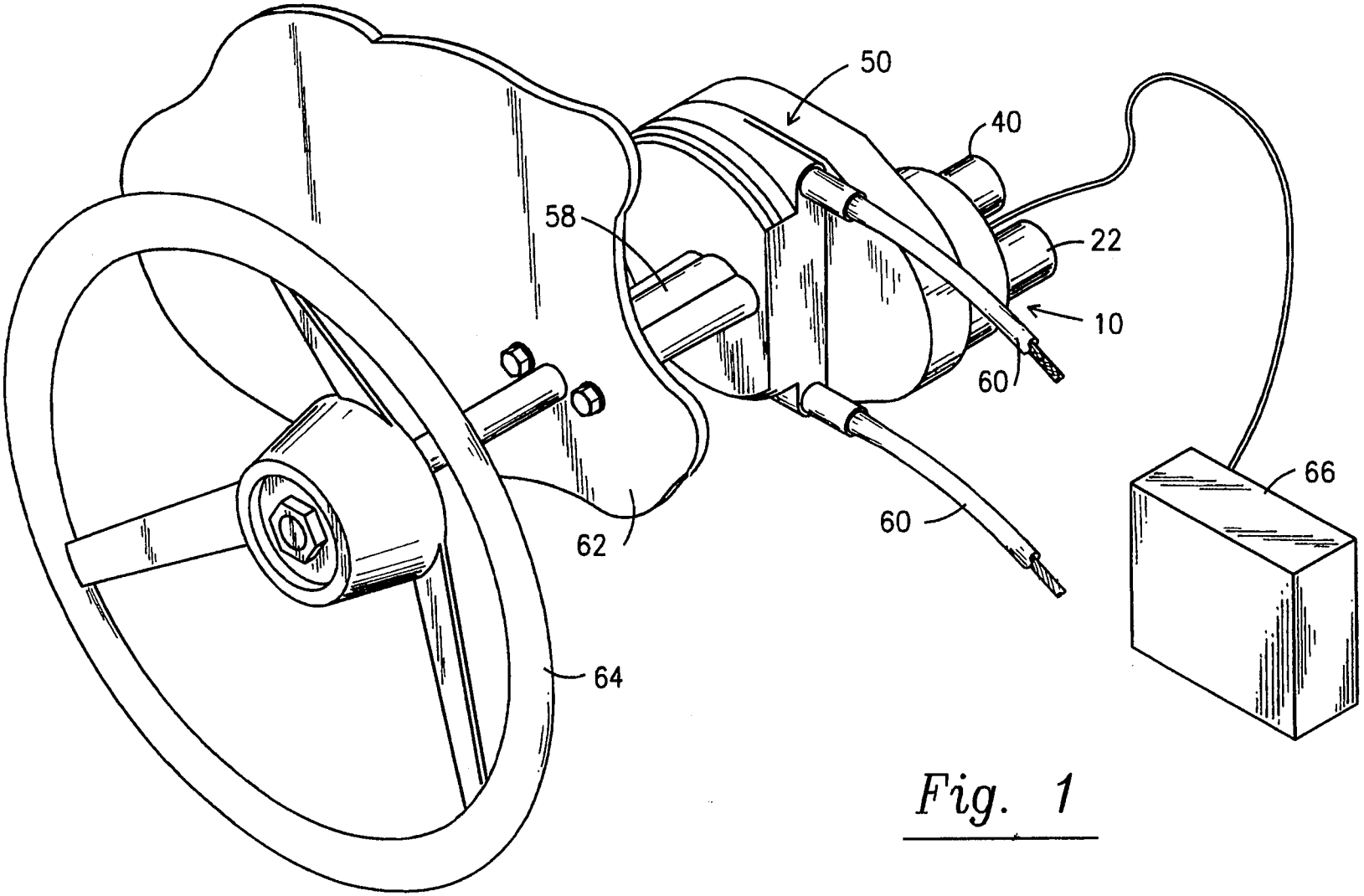
FIG. 1 is a front perspective view of the mounting relationship of the watercraft steering mechanism, dashboard panel, rotary helm unit, actuator and autopilot unit.
Figure 2:
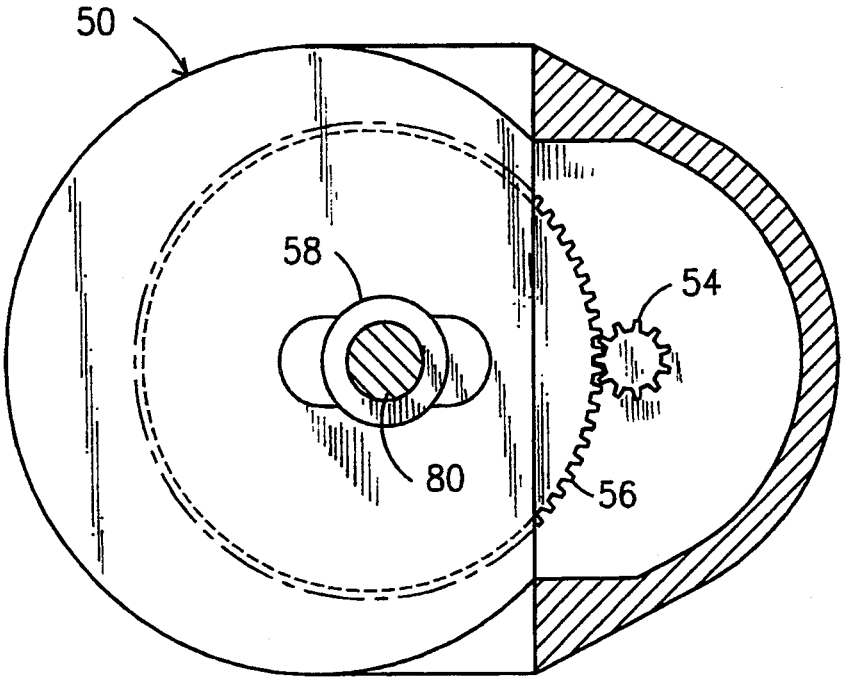
FIG. 2 is a sectional view of the front end of the rotary helm unit with the wheel steering shaft engaged to a pinion gear driven by a steering shaft extension in the actuator.

Throughout the following detailed description, the same reference numerals refer to the same elements in all figures.

Figure 4:
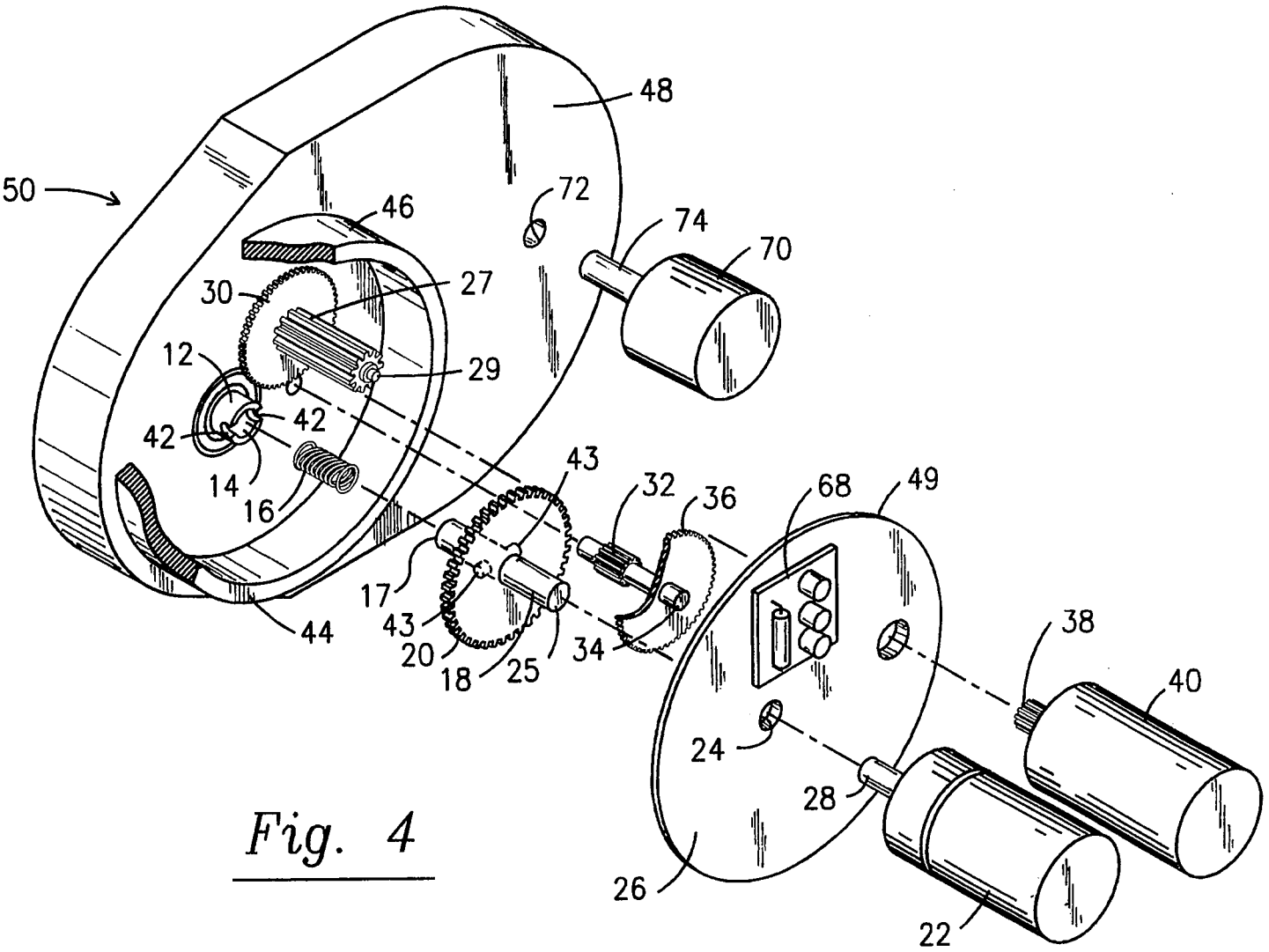
FIG. 4 is an exploded view of the actuator.
Figure 6:
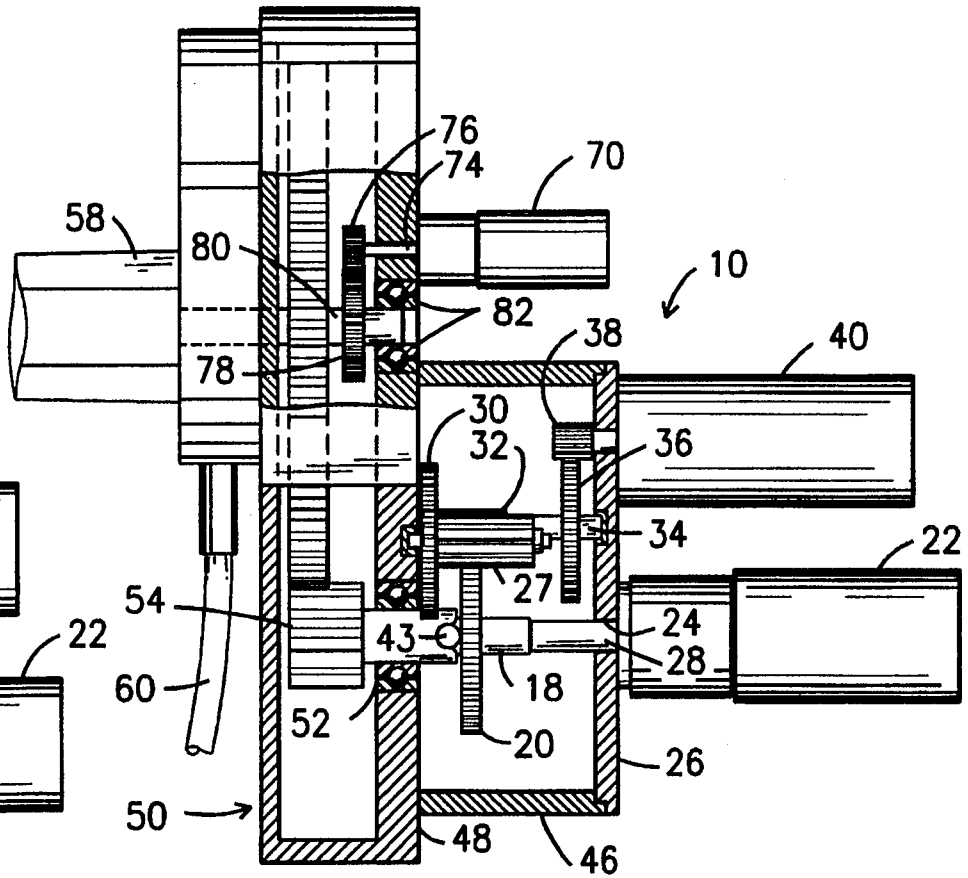
FIG. 6 is a sectional side elevational view of the actuator engaged to the rotary helm unit.

The actuator 10 shown in FIG. 4 has a drive shaft or wheel shaft extension 12 which is drilled out to expose a cavity 14 into which is inserted a spring 16. Such spring 16 pushes on the first end 17 of pusher shaft 18 which is attached to a first standard gear 20. A solenoid 22 is attached through hole 24 in base plate 26 so that the solenoid push pin 28 passes through hole 24 and engages a second end 25 of shaft 18 distal from spring 16. When the solenoid 22 is engaged, the push pin 28 moves forward and moves shaft 18 downward against the pressure on spring 16 so that the gear 20 slides along first pinion gear 27 which is affixed to shaft 29 along with second standard gear 30. First pinion gear 27 turns as a result of turning standard gear 30. Gear 30 rotates as a result of engagement with a second pinion gear 32 which is attached on shaft 34 along with third standard gear 36. Third standard gear 36 rotates as a direct result of rotation of third pinion gear 38 which is attached directly to motor 40. Therefore, when motor 40 turns third pinion gear 38, it turns standard gear 36 which turns second pinion gear 32 that turns second standard gear 30 which in turn, turns first pinion gear 27. Pinion gear 27 is of such length that it engages gear 20 when the solenoid is energized as shown in FIG. 6. Gears 20, 27, 30, 32, 36 and 38 act as reducing gears within the actuator 10.

Pin 43 transversely positioned and integral with shaft 18 engages with two grooves 42 along opposite sides of wheel shaft extension 12 to cause drive shaft 12 to turn when solenoid 22 is energized and motor 40 is running.

Top edge 44 of actuator housing 46 receives a bottom surface 49 of base plate 26 in order to enclose the actuator gearing.

Housing 46 is attached to the back wall 48 of a rotary helm unit 50 either by welding housing 46 to surface 48 or by employing mounting tabs on housing 46 which can then be screwed into housing surface 48.

Figure 5:
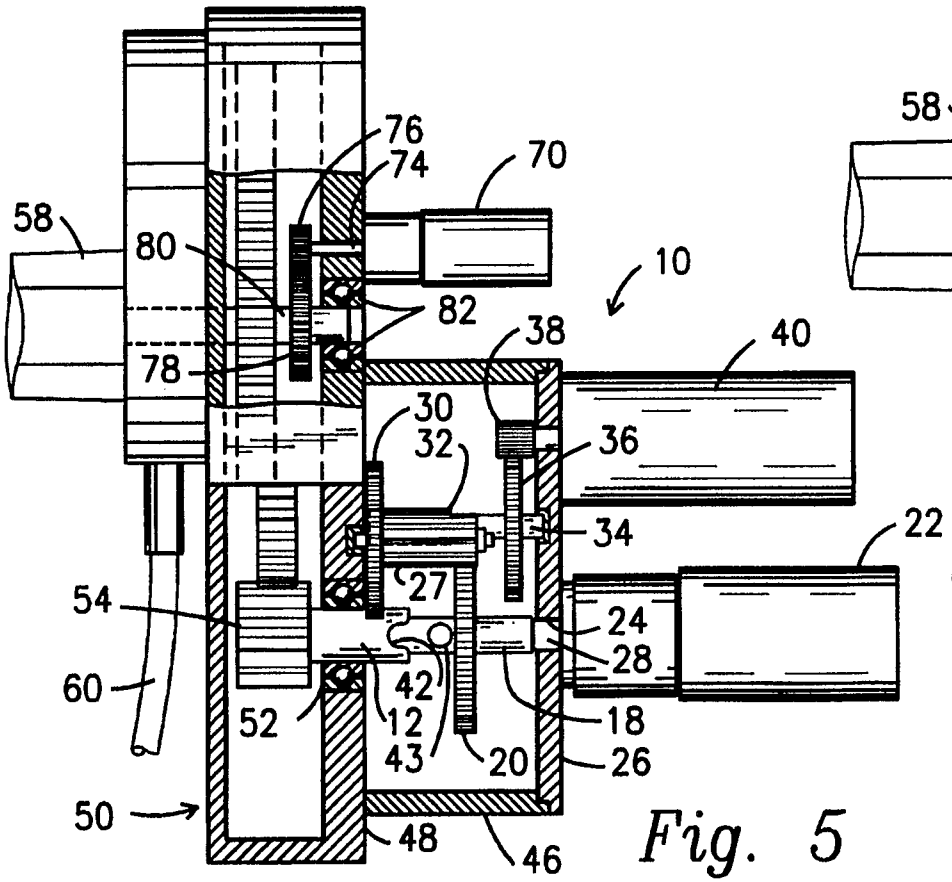
FIG. 5 is a sectional side elevational view of the actuator disengaged from the rotary helm unit.

The rotary helm unit 50 can contain gears as shown in FIGS. 5 and 6 or can have a rack and pinion arrangement as employed in some commercial rotary helm units. In the rotary helm unit depicted in the drawings, the steering shaft extension 12 rides on bearings 52 located within a first axial bore in back surface 48 of the rotary helm unit 50. Shaft extension 12 turns rotary helm unit pinion gear 54 which in turn rotates standard helm gear 56. Gear 56 rotates steering shaft 58 as well as winding telescopic cable 60 controlling the watercraft's rudder movement.

Figure 3:
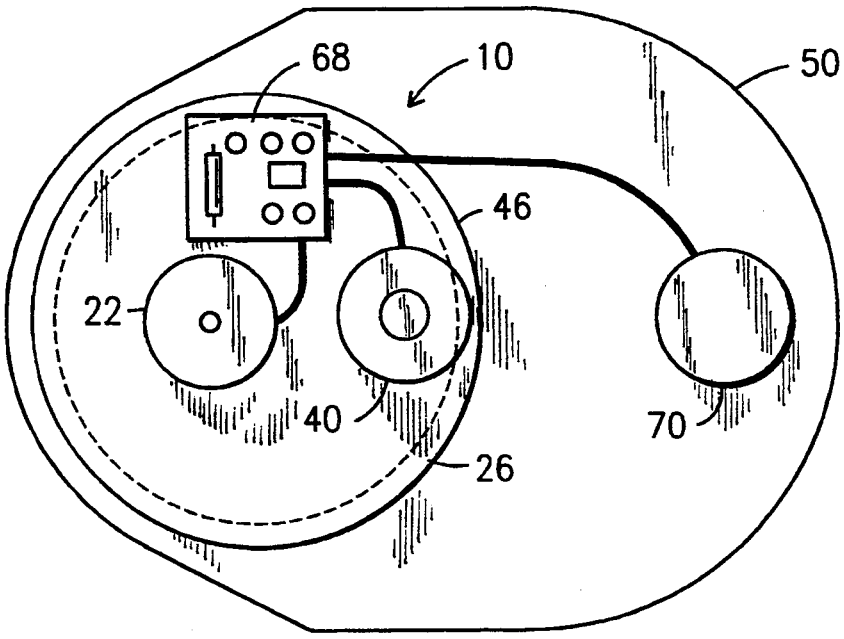
FIG. 3 is a sectional view of the back end of the actuator with clutch solenoid, motor, circuit board and potentiometer portion of the actuator visible.

The combined rotary helm unit 50 and autopilot actuator 10 are mounted below the watercraft dashboard panel 62 and the steering wheel 64 as shown in FIG. 1. The autopilot control box 66 can be mounted in any convenient location in the wheelhouse area. A computer circuit board 68 as shown in FIGS. 3 and 4 can control the operation of the solenoid 22 and motor 40 as well as an optional potentiometer 70 which can be mounted through a second bore 72 located in the back surface 48 of the rotary helm unit.

The potentiometer 70 has a shaft 74 passing through bore 72 into the rotary helm unit 50 where it engages a gear 76 which is rotated by gear 78 attached to a shaft 80 that moves in proportion to rotation of steering shaft 58. Thus potentiometer 70 can be used to determine the position of the watercraft's rudder since wheelshaft 58 is always positively connected to the rudder by means of telescopic cable 60. Shaft 80 is positioned at one end in the back wall 48 of the rotary helm unit between bearings 82.

The mechanical clutch unit depicted in the autopilot actuator 10 can be substituted with other well known prior art mechanical systems to engage a gear in the autopilot actuator with a shaft from a rotary helm unit to functionally accomplish the same results as shown above. Such substitute mechanical systems are hereby incorporated within the teaching of this invention.

Having thus described the invention, what is claimed and desired to be secured by Letters Patent is:

1. An autopilot actuator for use in a watercraft comprising the autopilot actuator configured to be securely mounted to a rotary helm unit housing under a dashboard panel of a watercraft, the autopilot actuator having a housing abutting a rear housing wall of the rotary helm unit, the autopilot actuator housing having a wall enclosing a mechanical clutch unit and a cover plate over the mechanical clutch unit, the mechanical clutch unit having a gear engaging a steering shaft extension from the rotary helm unit passing through a first bore in the rear housing wall of the rotary helm unit so that actuation of the mechanical clutch unit rotates a gear in the rotary helm unit to input a mechanical force to a telescopic output cable for steering purposes with all torque contained within the autopilot and rotary helm unit housings.

2. The autopilot actuator according to claim 1 wherein the steering shaft extension has a drilled out core containing resilient means and a pair of oppositely positioned grooves at an end of the steering shaft extension distal from the rear housing wall of the rotary helm unit, the resilient means exerting a force away from the core on a first end of a pusher shaft supported within the drilled out core of the steering shaft extension, the pusher shaft having an integral transverse pin pressed into the pair of oppositely positioned grooves at the end of the steering shaft extension when the resilient means exerted force is overcome by a plunger means pushing on a second end of the pusher shaft, a gear affixed to the pusher shaft adjacent the transverse pin on a side distal from the first end of the pusher shaft, gear means for engaging the gear affixed to the pusher shaft to turn the pusher shaft when the transverse pin is seated within the pair of grooves at the end of the steering shaft extension, the gear means activated by a motor mounted outside the autopilot actuator housing, the steering shaft extension turning in response to the pusher shaft engaged in the pair of grooves by the transverse pin and thereby turning gears in the rotary helm unit to input mechanical force to a telescopic output cable for steering the watercraft.

3. The autopilot actuator according to claim 2 wherein the resilient means is a coil spring.

4. The autopilot actuator according to claim 1 wherein a motor is mounted on the cover plate to actuate the mechanical clutch unit.

5. The autopilot actuator according to claim 4 wherein a solenoid is mounted on the cover plate, the solenoid having a plunger passing through a hole in the cover plate to push on a shaft within the mechanical clutch unit to cause rotation of the steering shaft extension when the motor and solenoid are in operation.

6. The autopilot actuator according to claim 4 wherein a computer circuit board is mounted on the cover plate and is electrically connected to the motor and solenoid to activate the motor and solenoid in accordance with programmed directions from an autopilot control box.

7. The autopilot actuator according to claim 1 wherein a potentiometer is mounted on the rear wall of the rotary helm unit with a shaft passing through a second axial bore in the rear wall to engage a gear within the rotary helm unit so that the potentiometer can be used to determine the position of the watercraft's rudder.

8. An autopilot actuator for use in a watercraft configured to be securely mounted to a rotary helm unit housing under a dashboard panel, the actuator comprising an actuator housing securely mounted to the rotary helm unit housing, the actuator housing enclosing a steering shaft extension mounted through a first axial bore through a back wall of the rotary helm unit housing, the steering shaft extension having a drilled out core containing resilient means and a pair of oppositely positioned grooves at an end of the steering shaft extension distal from the back wall of the rotary helm unit, the resilient means exerting a force away from the core on a first end of a pusher shaft supported within the drilled out core of the steering shaft extension, the pusher shaft having an integral transverse pin pressed into the pair of oppositely positioned grooves at the end of the steering shaft extension when the resilient means exerted force is overcome by a plunger means pushing on a second end of the pusher shaft, a pusher shaft gear affixed to the pusher shaft adjacent the transverse pin on a side distal from the first end of the pusher shaft, gear means for engaging the pusher shaft gear to turn the pusher shaft when the transverse pin is seated within the pair of grooves at the end of the steering shaft extension, the gear means activated through reducing gears by a motor adjacent the actuator housing, the steering shaft extension turning in response to the pusher shaft engaged by the transverse pin in the grooves and thereby turning gears in the rotary helm unit to control turning of the watercraft's rudder.

9. The autopilot actuator according to claim 8 wherein the resilient means is a coil spring.

10. The autopilot actuator according to claim 8 wherein a plate covers an end of the actuator housing distal from the back wall of the rotary helm unit and an electric motor and solenoid are mounted on the plate.

11. The autopilot actuator according to claim 10 wherein the solenoid has a shaft passing through an axial bore in the plate, the shaft acting as the plunger means to push on the second end of the pusher shaft.

12. The autopilot actuator according to claim 8 wherein a potentiometer is mounted on the back wall of the rotary helm unit with a shaft passing through a second axial bore in the back wall to engage a gear within the rotary helm unit so that the potentiometer can be used to determine the position of the watercraft's rudder.

13. An autopilot actuator for use in a watercraft adapted to be securely mounted to a rotary helm unit housing under a dashboard panel, the actuator comprising (a) an actuator housing securely mounted to the rotary helm unit housing, (b) a steering shaft extension mounted in an axial bore of a back wall of the rotary helm unit housing, the steering shaft extension having a drilled out core containing a spring and a pair of oppositely positioned grooves at an end of the steering shaft extension distal from the back wall of the rotary helm unit, (c) the spring exerting a force on a first end of a second shaft supported within the drilled out core of the steering shaft extension, the second shaft having an integral transverse pin pressed into the pair of oppositely positioned grooves at the distal end of the steering shaft extension when the spring force is overcome by a plunger pushing on a second end of the second shaft, (d) a first standard gear fixed to the second shaft at a portion distal from the spring, (e) a drive motor mounted on a top portion of an actuator housing plate enclosing the actuator housing, (f) the drive motor having a third shaft affixed to a first pinion gear, the pinion gear positioned adjacent a bottom portion of the actuator housing plate, (g) a spacer shaft mounted at a first end in the back wall of the rotary helm unit and at a second end in the bottom portion of the actuator housing plate, (h) a second standard gear affixed to a portion of the spacer shaft proximal to the bottom portion of the actuator housing plate and a second pinion gear affixed to a portion of the spacer shaft distal from the bottom portion of the actuator housing plate, and (i) the second standard gear turning the spacer shaft in response to the rotation of the first pinion gear upon actuation of the motor and the spacer shaft turning the second pinion gear at the same time, the first standard gear engaging the second pinion gear so that when the plunger pushes on the second end of the second shaft the steering shaft extension turns and engages gearing in the rotary helm unit to activate a telescopic steering cable.

14. The autopilot actuator according to claim 13 wherein a solenoid is mounted on the top portion of the actuator housing plate and is axially connected to the plunger so that activation of the solenoid causes the plunger to push on the second end of the second shaft.

15. The autopilot actuator according to claim 14 wherein a circuit board is mounted on the top portion of the actuator housing plate and inputs electrical energy to the motor and solenoid.

* * * * *